US010760796B2

(12) United States Patent
Abukawa et al.

(10) Patent No.: US 10,760,796 B2
(45) Date of Patent: Sep. 1, 2020

(54) OUTDOOR UNIT OF AIR-CONDITIONING APPARATUS

(71) Applicant: Mitsubishi Electric Corporation, Tokyo (JP)

(72) Inventors: Yui Abukawa, Tokyo (JP); Shinichi Uchino, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 77 days.

(21) Appl. No.: 16/065,174

(22) PCT Filed: Mar. 3, 2016

(86) PCT No.: PCT/JP2016/056676
§ 371 (c)(1),
(2) Date: Jun. 22, 2018

(87) PCT Pub. No.: WO2017/149736
PCT Pub. Date: Sep. 8, 2017

(65) Prior Publication Data

US 2018/0372344 A1 Dec. 27, 2018

(51) Int. Cl.
*F24F 1/10* (2011.01)
*F24F 1/40* (2011.01)
(Continued)

(52) U.S. Cl.
CPC ..... *F24F 1/40* (2013.01); *F24F 1/10* (2013.01); *F24F 1/16* (2013.01); *F24F 1/22* (2013.01);
(Continued)

(58) Field of Classification Search
CPC ..... F24F 1/46; F24F 1/10; F24F 1/26; F24F 1/20; F24F 1/22; F24F 13/24; F24F 2013/242; F24F 1/40
See application file for complete search history.

(56) References Cited

U.S. PATENT DOCUMENTS

2012/0192585 A1 8/2012 Hika et al.
2017/0089594 A1* 3/2017 Small, III ..... A47C 4/54

FOREIGN PATENT DOCUMENTS

CN 102620356 A 8/2012
CN 204329198 U 5/2015
(Continued)

OTHER PUBLICATIONS

JP 2012159224 Translation (Year: 2012).*
(Continued)

*Primary Examiner* — Brian M King
(74) *Attorney, Agent, or Firm* — Posz Law Group, PLC

(57) ABSTRACT

An outdoor unit of an air-conditioning apparatus includes a housing, a compressor disposed in the housing, an outdoor heat exchanger through which refrigerant supplied from the compressor flows, an air-sending device that sends air to the outdoor heat exchanger, an electric component box including an electric component that controls the compressor, a dividing plate that separates the compressor from an air-sending chamber accommodating the air-sending device, an electric component mount disposed above the compressor to partition a mechanical chamber accommodating the compressor from an electric component chamber accommodating the electric component box, and a support part for the electric component mount provided on an inner wall of the housing along an outer circumferential shape of the electric component mount to project toward an interior of the housing.

5 Claims, 5 Drawing Sheets

(51) Int. Cl.

| | |
|---|---|
| ***F24F 1/22*** | (2011.01) |
| ***F24F 13/20*** | (2006.01) |
| ***F24F 1/16*** | (2011.01) |
| ***F24F 1/26*** | (2011.01) |
| ***F24F 1/46*** | (2011.01) |
| *F24F 13/24* | (2006.01) |

(52) U.S. Cl.
CPC ..... *F24F 1/26* (2013.01); *F24F 1/46* (2013.01); *F24F 13/20* (2013.01); *F24F 13/24* (2013.01); *F24F 2013/242* (2013.01)

(56) References Cited

FOREIGN PATENT DOCUMENTS

| | | | |
|---|---|---|---|
| JP | H05-079661 | A | 3/1993 |
| JP | H05-141713 | A | 6/1993 |
| JP | H06-035835 | U | 5/1994 |
| JP | 2006-090565 | A | 4/2006 |
| JP | 2008-190806 | A | 8/2008 |
| JP | 2010-121857 | A | 6/2010 |
| JP | 2012-159224 | A | 8/2012 |
| JP | 2015-117858 | A | 6/2015 |

OTHER PUBLICATIONS

JP 2008190806 Translation (Year: 2008).*
Extended European Search Report dated Jan. 18, 2019 issued in corresponding EP patent application No. 16892576.6.
Office Action dated Jun. 25, 2019 issued in corresponding JP patent application No. 2018-502462 (and English translation).
International Search Report of the International Searching Authority dated May 31, 2016 for the corresponding International application No. PCT/JP2016/056676 (and English translation).
Office Action dated Dec. 2, 2019 issued in corresponding CN patent application No. 201680082735.0 (and English translation).
Office Action dated Jul. 14, 2020 issued in corresponding CN patent application No. 201680082735.0 (and English translation).

* cited by examiner

OUTDOOR UNIT OF AIR-CONDITIONING APPARATUS

CROSS REFERENCE TO RELATED APPLICATION

This application is a U.S. national stage application of International Application No. PCT/JP2016/056676, filed on Mar. 3, 2016, the contents of which are incorporated herein by reference.

TECHNICAL FIELD

This invention relates to an outdoor unit of an air-conditioning apparatus, and to measures against noise generated from a mechanical chamber storing a compressor, refrigerant pipes, and other devices.

BACKGROUND

In a housing of an outdoor unit of an air-conditioning apparatus, there are formed chambers such as a mechanical chamber storing a refrigerant circuit including a compressor, an electric component chamber storing electric components, and an air-sending chamber storing an air-sending device. In an existing outdoor unit of an air-conditioning apparatus, the air-sending chamber is divided from the mechanical chamber and the electric component chamber, but the mechanical chamber and the electric component chamber are not divided from each other. Consequently, sound generated in the mechanical chamber may leak to the outside of the outdoor unit from the air-sending chamber via the electric component chamber and cause noise. To address such noise, an air-conditioning apparatus is disclosed in which a compressor chamber and an electric component chamber are partitioned by a dividing plate to prevent noise generated by a compressor from leaking to the outside of an apparatus body (see Patent Literature 1). Further, an outdoor unit of an air-conditioning apparatus is disclosed in which a mechanical chamber partitioned from an air-sending device chamber is separated by an electric component box into a compressor chamber storing a compressor and an air passage chamber allowing communication between the air-sending device chamber and the outside (see Patent Literature 2). Patent Literature 2 discloses that the electric component box has one end surface contacting a dividing plate and is formed to have a shape contacting front and rear surfaces and a side surface of an outer box of the outdoor unit.

PATENT LITERATURE

Patent Literature 1: Japanese Unexamined Patent Application Publication No. 5-141713

Patent Literature 2: Japanese Unexamined Utility Model Registration Application Publication No. 6-35835

As in Patent Literatures 1 and 2, the noise of the mechanical chamber is due to vibration and noise generated when the compressor is driven, for example. Consequently, dividing the space in the housing with a combination of parts such as a plurality of separately formed metal plates raises an issue of the sound generated from the mechanical chamber and leaking through gaps between those parts and the vibration transmitted to generate new noise.

SUMMARY

This invention has been made to address the above-described issue, and aims to provide an outdoor unit of an air-conditioning apparatus with reduced leakage of noise generated in the mechanical chamber.

An outdoor unit of an air-conditioning apparatus according to an embodiment of this invention includes a housing, a compressor disposed in the housing, an outdoor heat exchanger connected to the compressor via a refrigerant pipe, an air-sending device configured to send air to the outdoor heat exchanger, an electric component box including an electric component configured to control the compressor, a dividing plate dividing an interior of the housing into a mechanical chamber accommodating the compressor and an air-sending chamber accommodating the air-sending device, an electric component mount disposed above the compressor to partition the mechanical chamber from an electric component chamber accommodating the electric component box, and a support part provided along an outer circumferential shape of the electric component mount to project from an inner wall of the housing toward the interior of the housing to support the electric component mount.

In the outdoor unit of the air-conditioning apparatus according to an embodiment of this invention, the electric component mount is supported by the support part of the housing to partition the mechanical chamber and the electric component chamber from each other, thereby reducing an airflow from the mechanical chamber. Further, the support part is provided on the inner wall of the housing along the outer circumferential shape of the electric component mount to enable a reduction in a gap between the housing and the electric component mount and an increase in the degree of sealing of the mechanical chamber. The leakage of noise to the outside of the outdoor unit is reduced, accordingly. Further, the support part is provided to project toward the interior of the housing, thereby facilitating the installation of the electric component mount.

DETAILED DESCRIPTION

Embodiment 1

Figure 1:
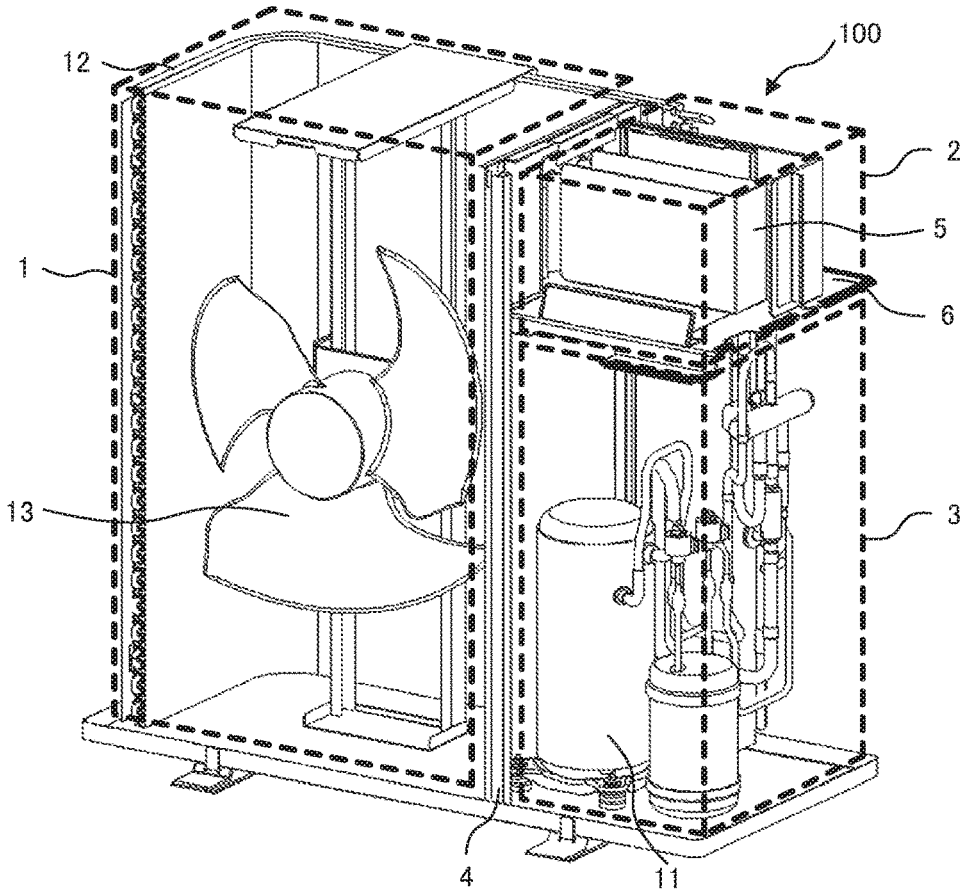
FIG. 1 is a perspective view illustrating an outdoor unit of an air-conditioning apparatus according to Embodiment 1 of the present invention.

FIG. 1 is a perspective view illustrating an outdoor unit of an air-conditioning apparatus according to Embodiment 1 of the present invention. FIG. 1 illustrates an internal configuration of an outdoor unit 100 with a part of a housing removed. In the outdoor unit 100 of the air-conditioning apparatus, a compressor 11 provided with an electric motor, a four-way valve that switches refrigerant passages, a pressure reducing device, an outdoor heat exchanger 12 through which refrigerant supplied from the compressor 11 flows, an air-sending device 13 that sends air to the outdoor heat exchanger 12, an electric component box 5 including an electric component for controlling the compressor 11, and other devices are disposed in the housing forming an outer frame. Further, the compressor 11, the four-way valve, the outdoor heat exchanger 12, and the pressure reducing device installed in the outdoor unit 100 and an indoor heat exchanger installed in an indoor unit are connected via refrigerant pipes to form a refrigeration cycle.

The housing of the outdoor unit 100, as viewed from its front, includes a top surface panel forming an upper surface, a bottom plate forming a bottom surface, a front panel forming a left front surface and a left side surface, a rear surface panel forming a left rear surface, a mechanical chamber front surface panel, and a mechanical chamber rear surface panel. The mechanical chamber front surface panel forms a right front surface and a front portion of a right side surface of the housing, and the mechanical chamber rear surface panel forms a rear portion of the right side surface and a right rear surface of the housing. Each of these panels forming the housing is a component made of a metal plate, which may be divided into smaller parts or may be integrally formed.

As illustrated in FIG. 1, a dividing plate 4 partitioning the interior of the housing of the outdoor unit 100 into left and right sections is installed upright on the bottom plate. With the dividing plate 4, an air-sending chamber 1 provided on the left side to store the air-sending device 13 is separated from the compressor 11 and the electric component box 5 disposed on the right side. The outdoor unit 100 further includes an electric component mount 6 attachable to and detachable from the housing. When the electric component mount 6 is disposed above the compressor 11 with the electric component box 5 installed on an upper surface of the electric component mount 6, the electric component mount 6 partitions a mechanical chamber 3 accommodating the compressor 11 and an electric component chamber 2 accommodating the electric component box 5 from each other.

The air-sending chamber 1 is provided with the outdoor heat exchanger 12, the air-sending device 13, and other devices. The air-sending chamber 1 is a space surrounded by the rear surface panel, the front panel, the dividing plate 4, the top surface panel, and the bottom plate. The outdoor heat exchanger 12 exchanges heat between the refrigerant and outside air, and acts as an evaporator in a heating operation and as a condenser in a cooling operation. The outdoor heat exchanger 12, which is made of heat transfer pipes allowing the refrigerant to pass through the heat transfer pipes and fins for increasing the area of heat transfer between the refrigerant flowing through the heat transfer pipes and the outside air, for example, has flat plate areas and a curved surface area, and has a cross section formed into a substantially L-shape. The outdoor heat exchanger 12 is disposed such that a long side portion of the substantially L-shape extends along the rear surface panel of the air-sending chamber 1. The shape of the outdoor heat exchanger 12 is not limited to the substantially L-shape. For example, the outdoor heat exchanger 12 may only include a flat plate area.

Further, the air-sending device 13 made of a device including a fan and a fan motor that drives the fan to rotate, such as a propeller fan, is installed in front of the long side portion of the outdoor heat exchanger 12 in the air-sending chamber 1. An almost entire surface of the rear surface panel covering the rear surface of the air-sending chamber 1 is provided with air inlets. Further, a portion of a front surface of the front panel facing to the air-sending device 13 is provided with air outlets forming a circular shape, and a rear surface of the front panel is provided with a bell mouth to surround the outer circumference of the fan. During the driving of the air-sending device 13, the outside air is suctioned from the air inlets and guided to the air outlets by the bell mouth through the outdoor heat exchanger 12 and the air-sending chamber 1 to be discharged to the outside of the outdoor unit 100.

For example, the compressor 11, the four-way valve, the pressure reducing device, and a refrigerant pipe group are disposed in the mechanical chamber 3. The mechanical chamber 3 is a space surrounded by the electric component mount 6, the bottom plate, the dividing plate 4, the mechanical chamber front surface panel, and the mechanical chamber rear surface panel. The four-way valve includes four ports, and switches the directions of the refrigerant passages by switching the connection states of the four ports depending on the operating state, such as the cooling operation and the heating operation. The pressure reducing device is made of an electronic expansion valve, for example, and reduces the pressure of the refrigerant. For example, refrigerant pipes such as a refrigerant pipe connecting a gas-side connecting pipe and the four-way valve, a suction pipe and a discharge pipe connected to the compressor 11, a refrigerant pipe connecting the four-way valve and the outdoor heat exchanger 12, a refrigerant pipe connecting the outdoor heat exchanger 12 and the pressure reducing device, and a refrigerant pipe connecting the pressure reducing device and a liquid-side connecting pipe are collectively referred to as the refrigerant pipe group.

In the compressor 11, a compression mechanism unit in which a compression element rotates to compress the refrigerant and an electric motor unit that drives the compression element of the compression mechanism unit to rotate are included in a sealed container made of an upper lid, a cylindrical container, and a bottom lid made of steel plates. In the compressor 11, which is of a high-pressure shell type, for example, the refrigerant from the suction pipe flows into the compression element of the compression mechanism unit, and refrigerant gas compressed in the compression mechanism unit is discharged into the sealed container from the compression mechanism unit to flow into the discharge pipe communicating with the interior of the sealed container. Further, the compression element employed here is of a scroll type in which a movable scroll blade orbits around a fixed scroll blade to suction and compress the refrigerant. The type of the compressor 11 is not particularly limited to such a scroll type, and may be another type, such as a rotary type in which a cylindrical piston in a cylinder rotates to suction and compress the refrigerant, for example. The thus-configured compressor 11 is installed on the bottom plate via an anti-vibration rubber to reduce the generation of noise due to vibration occurring during the driving.

The electric component chamber 2 is provided with the electric component box 5, a heat sink, and other devices. The electric component chamber 2 is a space surrounded by the top surface panel, the electric component mount 6, the dividing plate 4, the mechanical chamber front surface panel, and the mechanical chamber rear surface panel. The electric component box 5 stores a control board on which electric components are mounted such as a power module that controls the compressor 11 and the air-sending device 13, a capacitor, a resistor, and a transistor. Further, a heat sink provided with heat transfer fins is installed on the rear surface side of the electric component box 5. The dividing plate 4 and the mechanical chamber front surface panel or the mechanical chamber rear surface panel may be provided with openings at the height of the electric component chamber 2. As the outside air is taken in and suctioned into the air-sending chamber 1 during the operation of the air-sending device 13, it is possible to cool the air of the electric component chamber 2 heated by the heat generated by devices such as the power module.

Figure 2:
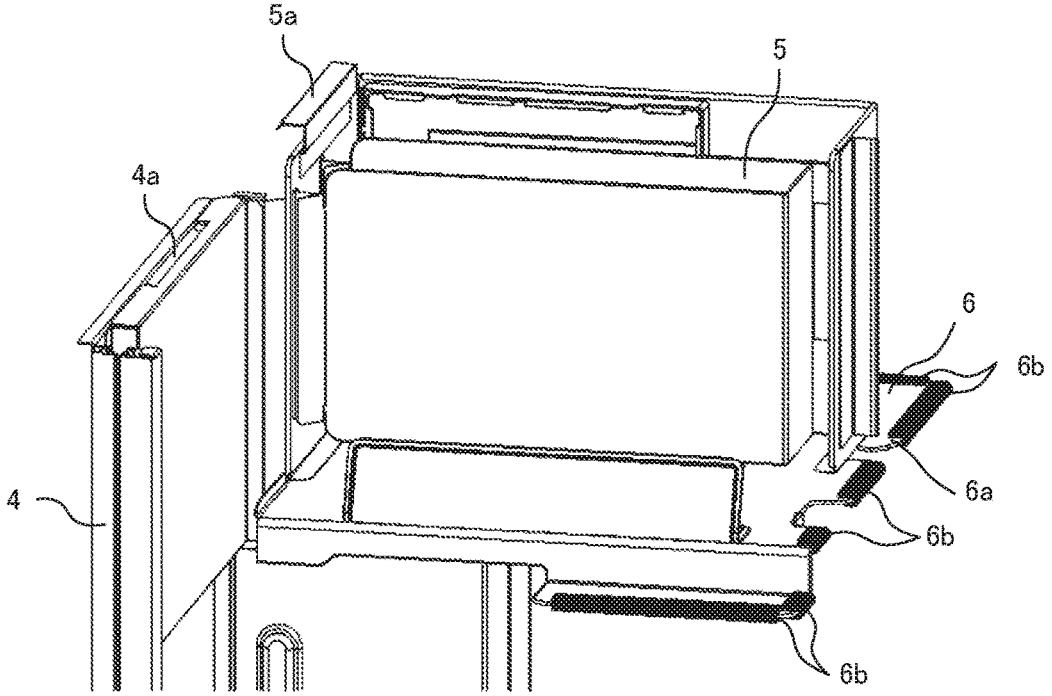
FIG. 2 is a perspective view illustrating an electric component box and a dividing plate according to Embodiment 1 of the present invention.

FIG. 2 is a perspective view illustrating the electric component box and the dividing plate according to Embodiment 1 of the present invention. In FIG. 2, the electric component box 5 is already installed and fixed on the upper surface of the electric component mount 6. The electric component mount 6 may be integrally formed with the bottom surface of the electric component box 5.

A catch hole 4*a* is provided to an upper end of the dividing plate 4. To an upper end of a side surface of the electric component box 5 contacting the dividing plate 4, a catch part 5*a* is provided to be engaged with the catch hole 4*a* of the dividing plate 4 from above. For example, the catch part 5*a* may be an inverse U-shaped hook extending from an upper portion of the side surface to face the dividing plate 4. With the catch part 5*a* engaged with the catch hole 4*a*, the electric component box 5 is installed in the housing.

Figure 3:
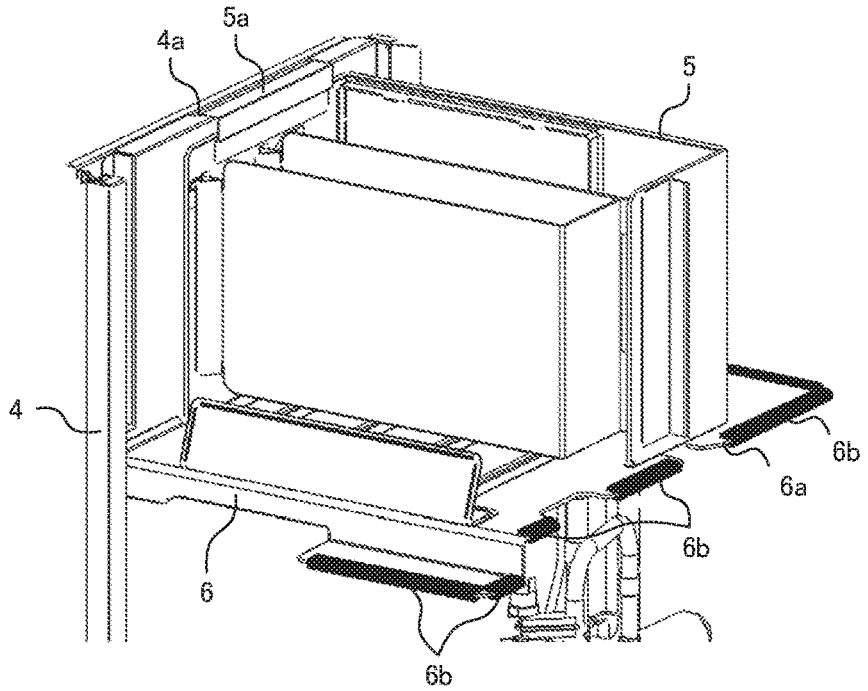
FIG. 3 is a perspective view illustrating an electric component chamber partitioned by an electric component mount according to Embodiment 1 of the present invention.

FIG. 3 is a perspective view illustrating the electric component chamber partitioned by the electric component mount according to Embodiment 1 of the present invention. As in FIG. 3, with the catch part 5*a* of the electric component box 5 engaged with the catch hole 4*a* of the dividing plate 4, the electric component box 5 is installed above the compressor 11, and the electric component mount 6 divides the electric component chamber 2 and the mechanical chamber 3 from each other.

Figure 4:
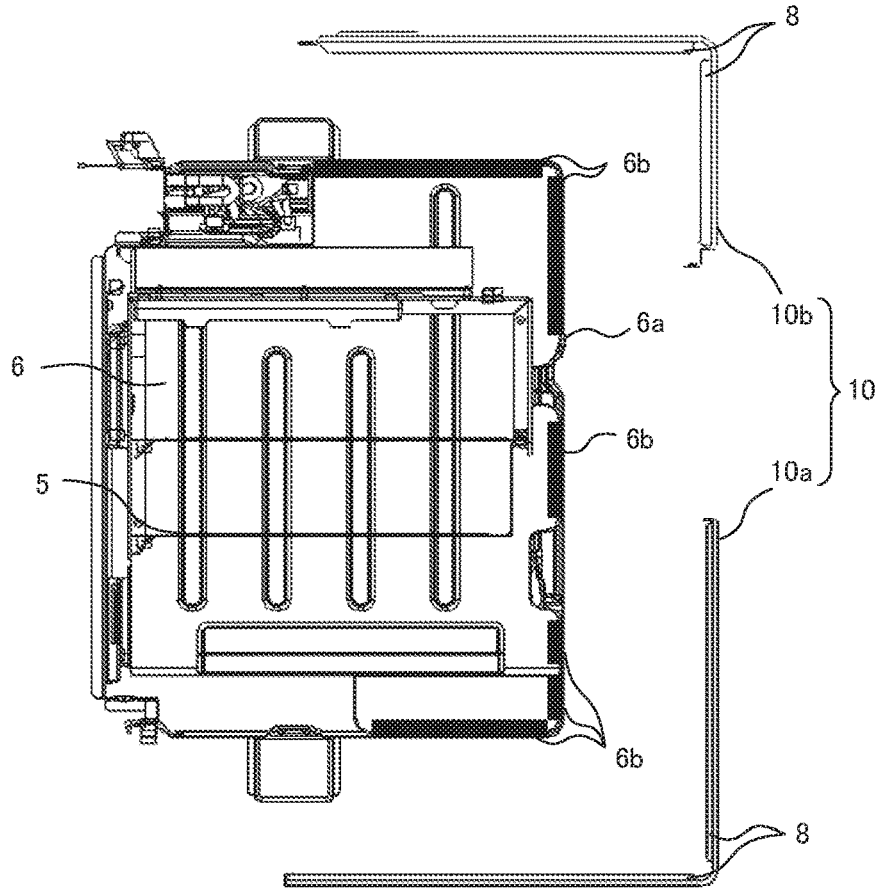
FIG. 4 is a top view illustrating positions for applying cushioning materials for the electric component mount according to Embodiment 1 of the present invention.

FIG. 4 is a top view illustrating positions for applying cushioning materials for the electric component mount according to Embodiment 1 of the present invention. On inner walls of the mechanical chamber front surface panel 10*a* and the mechanical chamber rear surface panel 10*b* of the housing 10, support parts 8 are provided along an outer circumferential shape of the electric component mount 6 to project toward the inside. Further, the electric component mount 6 includes cushioning materials 6*b* provided to an outer circumferential end 6*a*. When the flat plate-shaped electric component mount 6 is installed in the housing 10, the electric component mount 6 is placed with the cushioning materials 6*b* contacting the support parts 8. To this end, the cushioning materials 6*b* are applied to surfaces on the outer circumference of the electric component mount 6 brought into contact with and stopped by the support parts 8 of the housing 10.

Further, the cushioning materials 6*b* may be continuously provided on, of the electric component mount 6, the upper surface, a side surface facing an inner wall of the housing 10, and portions of a lower surface contacting the support parts 8. It is thereby possible to reduce a gap between the electric component mount 6 and the housing 10. Further, there is no direct contact between metal plates, thereby enabling reduction of noise and vibration. Further, it is also possible to prevent the occurrence of chattering sound caused by contact of metal plates due to vibration, for example.

The support parts 8 may be disposed at locations with intervals between the support parts 8, for example. Further, the support parts 8 may have a horizontal plate shape to continuously extend along the panels forming the housing 10. When such a plate-shaped support part 8 is employed, the degree of sealing of the mechanical chamber 3 is increased, thereby enabling a reduction in the leakage of noise from the mechanical chamber 3. Further, for example, when the support parts 8 are provided on a front portion of a right side surface of the mechanical chamber front surface panel 10*a* and a rear portion of a right side surface of the mechanical chamber rear surface panel 10*b*, the electric component mount 6 is supported from below by the support parts 8 at the position of a side of the electric component mount 6 opposite to a side of the electric component mount 6 contacting the dividing plate 4. Consequently, the electric component mount 6 and the electric component box 5 installed on the electric component mount 6 are stably installed in the outdoor unit 100 by the dividing plate 4 and the support parts 8.

Figure 5:
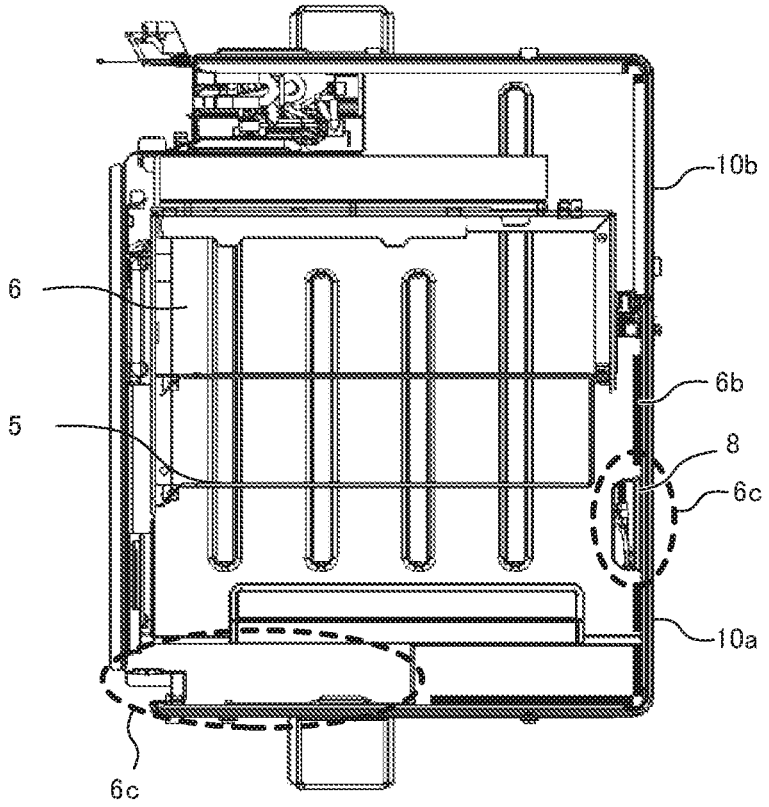
FIG. 5 is a top view illustrating positions of cutouts for wires in the electric component mount according to Embodiment 1 of the present invention.

FIG. 5 is a top view illustrating positions of cutouts for wires in the electric component mount according to Embodiment 1 of the present invention. The mechanical chamber 3 is kept sealed by devices such as the electric component mount 6, the support parts 8, and the cushioning materials 6*b*. Meanwhile, the outdoor unit 100 needs wires for driving the outdoor unit 100. For example, wires connecting the electric component box 5 to the compressor 11 are required. Consequently, the outer circumferential end 6*a* of the electric component mount 6 is provided with a cutout 6*c* that passes through the electric component chamber 2 and the mechanical chamber 3 to allow the wires to pass through the cutout 6*c*. With the cutout 6*c*, a wire path from the mechanical chamber 3 to the electric component chamber 2 is secured. The cutout is formed into a size depending on the thickness of the wires extending from the mechanical chamber 3 to the electric component chamber 2. With the thus-formed cutout, the opening of the cutout 6*c* is filled by the wires. Further, it is preferable to maintain the sealed state of the mechanical chamber 3 by providing an elastic cushioning material in a gap between the cutout and the wires.

Further, the cutout 6*c* may be formed on the front surface side of the outer circumferential end 6*a* of the electric component mount 6 or in a front portion of a right side surface of the outer circumferential end 6*a* of the electric component mount 6, as illustrated in FIG. 5, for example. The cutout 6*c* provided at such a position facilitates wiring work. Specifically, in the assembling of the outdoor unit 100, the wires can be connected to the electric component box 5 and the compressor 11 after the electric component mount 6 is installed in the outdoor unit 100 and before the mechanical chamber front surface panel 10*a* is assembled to the outdoor unit 100. After the connection is completed, the front surface panel can be installed with the wires fitted in the unclosed cutout 6*c*.

Figure 6:
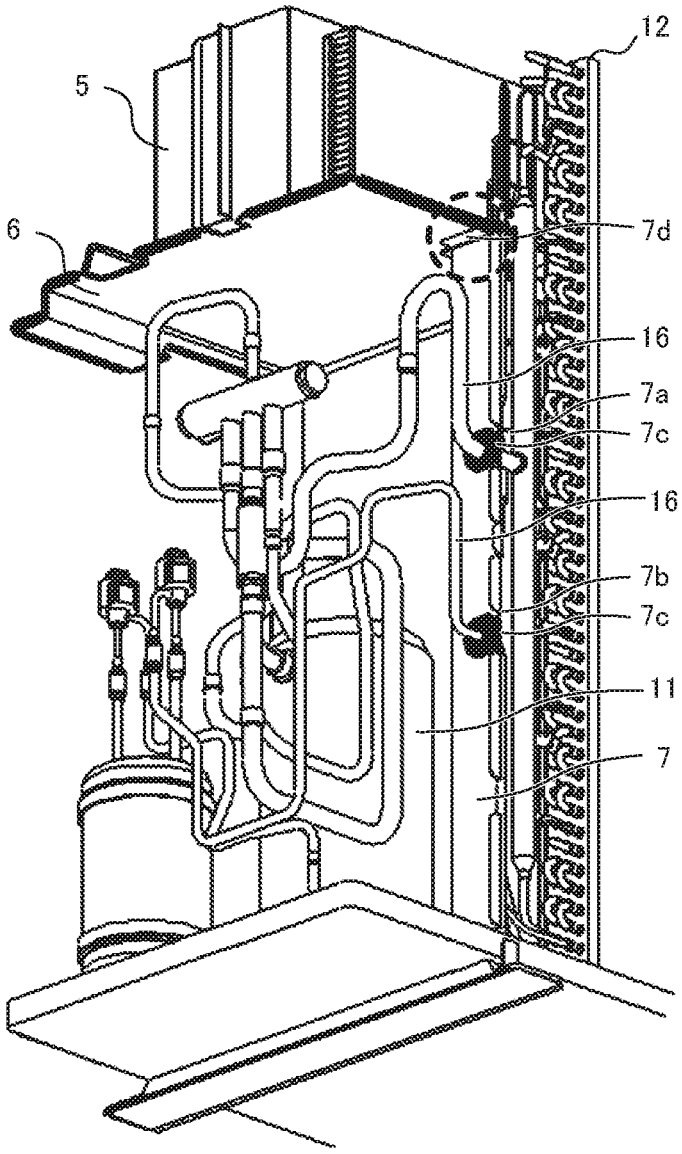
FIG. 6 is a rear surface perspective view illustrating a heat exchanger cover according to Embodiment 1 of the present invention, which separates a mechanical chamber and an outdoor heat exchanger from each other.

FIG. 6 is a rear surface perspective view illustrating a heat exchanger cover according to Embodiment 1 of the present invention, which separates the mechanical chamber and the outdoor heat exchanger from each other. FIG. 6 illustrates details of the mechanical chamber 3 and the electric component chamber 2, from which the top surface panel, the mechanical chamber front surface panel 10*a*, and the mechanical chamber rear surface panel 10*b* are removed. As illustrated in FIG. 6, the outdoor heat exchanger 12 may extend to behind the compressor 11 along the rear surface side of the housing 10. In such a case, a heat exchanger cover 7 is provided on the rear surface side of the dividing plate 4 to separate the outdoor heat exchanger 12 and the compressor 11 from each other. The heat exchanger cover 7 has a shape bent to project toward the mechanical chamber 3 further than the dividing plate 4. That is, the heat exchanger cover 7 divides the outdoor heat exchanger 12 that requires to exchange heat with the outside air and the mechanical chamber 3 that should be sealed to prevent the leakage of noise.

Further, refrigerant pipes such as a refrigerant pipe 16 connecting the four-way valve and the outdoor heat exchanger 12 and a refrigerant pipe 16 connecting the pressure reducing device and the outdoor heat exchanger 12 are installed in the mechanical chamber 3. Consequently, the heat exchanger cover 7 is provided with pipe ports 7*a* and 7*b* through which the respective refrigerant pipes 16 pass. For example, the outdoor heat exchanger 12 has a header pipe, and the refrigerant pipe 16 connecting the four-way valve of the mechanical chamber 3 and the outdoor heat exchanger 12 is connected to the header pipe through the pipe port 7*a*. The header pipe distributes the refrigerant to a plurality of heat transfer pipes. The refrigerant pipe 16 connecting the outdoor heat exchanger 12 and the pressure reducing device passes through the pipe port 7*b*. Each of these pipe ports 7*a* and 7*b* is formed to have a minimum size allowing a corresponding one of the refrigerant pipes 16 connected to the outdoor heat exchanger 12 to pass through a corresponding one of the pipe ports 7*a* and 7*b*. Further, a pipe port cushioning material 7*c* made of rubber, for example, is each provided to the pipe ports 7*a* and 7*b* to fix a corresponding one of the refrigerant pipes 16 passing through a corresponding one of the pipe ports 7*a* and 7*b*, and is in close contact with an opening circumferential portion of a corresponding one of the pipe ports 7*a* and 7*b* to close a gap and reduce the leakage of noise and the transmission of vibration. For example, each of the pipe port cushioning materials 7*c* may be a ring-shaped cushioning material having a hole at its center to allow a corresponding pipe to pass through the hole.

Figure 7:
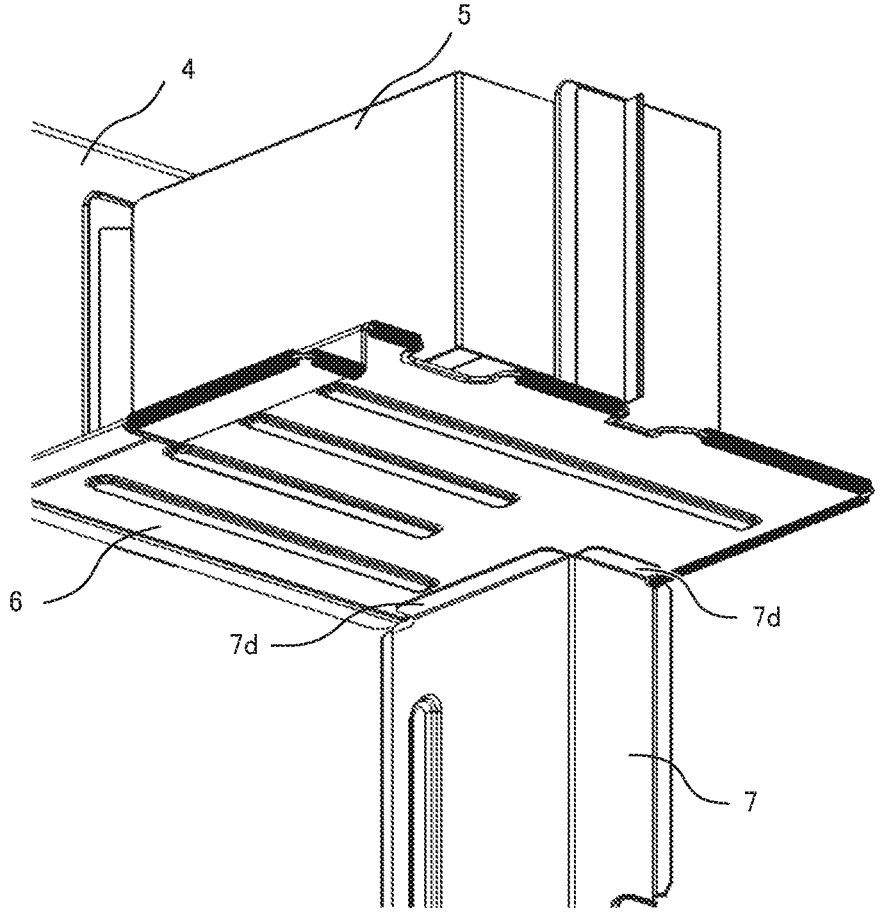
FIG. 7 is a partial schematic diagram illustrating the electric component mount supported by the heat exchanger cover according to Embodiment 1 of the present invention.

FIG. 7 is a partial schematic diagram illustrating the electric component mount supported by the heat exchanger cover according to Embodiment 1 of the present invention. The heat exchanger cover 7 covers the outdoor heat exchanger 12 from the bottom plate to the position of a boundary between the mechanical chamber 3 and the electric component chamber 2. Further, one end of the heat exchanger cover 7 is connected to the dividing plate 4, and the other end of the heat exchanger cover 7 is connected to the mechanical chamber rear surface panel 10*b*. When the electric component mount 6 on which the electric component box 5 is installed is installed in the outdoor unit 100, the lower surface of the electric component mount 6 contacts an upper end portion of the heat exchanger cover 7, and the electric component mount 6 and the electric component box 5 are supported from below. For example, to an upper end of the heat exchanger cover 7, bent portions 7*d* may be provided by bending each portion of the upper end toward the mechanical chamber 3 by approximately 90 degrees. The upper end is bent to form a horizontal surface having a height substantially the same as the height of the support parts 8. In this case, the lower surface of the electric component mount 6 is in contact with and supported by the horizontal surfaces of the bent portions 7*d*.

As described above, the outdoor unit 100 of the air-conditioning apparatus in Embodiment 1 includes the housing 10, the compressor 11 disposed in the housing 10, the outdoor heat exchanger 12 connected to the compressor 11 via the refrigerant pipes, the air-sending device 13 that sends air to the outdoor heat exchanger 12, the electric component box 5 including the electric component that controls the compressor 11, the dividing plate 4 that divides the interior of the housing 10 into the mechanical chamber 3 accommodating the compressor 11 and the air-sending chamber 1 accommodating the air-sending device 13, the electric component mount 6 disposed above the compressor 11 to partition the mechanical chamber 3 from the electric component chamber 2 accommodating the electric component box 5, and the support parts 8 provided along the outer circumferential shape of the electric component mount 6 to project from the inner walls of the housing 10 toward the interior of the housing 10 to support the electric component mount 6.

Consequently, the electric component mount 6 is supported by the support parts 8 provided to the housing 10, and partitions the mechanical chamber 3 and the electric component chamber 2 from each other, thereby enabling the reduction of an airflow from the mechanical chamber 3 accommodating the compressor 11 into the electric component chamber 2. Further, the support parts 8 are provided to the housing 10 along the outer circumferential shape of the electric component mount 6, thereby enabling a reduction in the gap between the housing 10 and the electric component mount 6 and an increase in the degree of sealing of the mechanical chamber 3. Consequently, it is possible to reduce the leakage of noise to the outside of the outdoor unit 100. Further, the installation of the electric component mount 6 into the outdoor unit 100 is facilitated.

Further, the electric component mount 6 may have the cushioning materials 6*b* provided to the outer circumferential end 6*a*, and the support parts 8 may support the cushioning materials 6*b* of the electric component mount 6. It is thereby possible to prevent sounds such as chattering sound generated between the electric component mount 6 and the support parts 8. Further, the cushioning materials 6*b* reduce the gap between the electric component mount 6 and the housing 10 or the support parts 8, thereby enabling a reduction in the leakage of noise. Further, the cushioning materials 6*b* absorb vibration and thus are capable of reducing the transmission of vibration generated by the compressor 11, thereby leading to a reduction in noise.

Further, the cushioning materials 6*b* may be continuously provided on, of the electric component mount 6, the upper surface, the side surface facing the inner wall of the housing 10, and the portions of the lower surface contacting the support parts 8. It is thereby possible to avoid direct contact between metal plates, and to prevent the generation of noise. Further, the adhesion between the electric component mount 6 and the housing 10 is increased.

Further, the catch hole 4*a* may be provided to the upper end of the dividing plate 4, and the electric component box 5 may be installed on the upper surface of the electric component mount 6 and include the catch part 5*a* to be engaged with the catch hole 4*a* from above. With this configuration, the mounting of the electric component box 5 in the outdoor unit 100 is facilitated. Further, the electric component mount 6 integrated with the electric component box 5 installed on the electric component mount 6 engages with the dividing plate 4 from above, and the side surfaces of the electric component mount 6 surrounded by other parts than the dividing plate 4 are supported from below by the support parts 8 of the housing 10. Consequently, the electric component mount 6 is stably installed in the outdoor unit 100.

Further, the outer circumferential end 6*a* of the electric component mount 6 may be provided with the cutout 6*c* passing through the electric component chamber 2 and the mechanical chamber 3 to allow the wires to pass through the cutout 6*c*. The cutout 6*c* is thereby provided in the outer circumferential end 6*a* to secure the wire path and improve the efficiency in working with the wires.

Further, the dividing plate 4 may also include the heat exchanger cover 7 that is bent toward the mechanical chamber 3 to separate the compressor 11 and the outdoor heat exchanger 12 from each other, the heat exchanger cover 7 may be provided with the pipe ports 7*a* and 7*b* through which the refrigerant pipes 16 pass, and the pipe ports 7*a* and 7*b* are each provided with the pipe port cushioning material 7*c*. Thereby, the pipe paths for the refrigerant pipes 16 are secured, and the transmission of vibration and the leakage of noise are reduced.

Further, the upper end portion of the heat exchanger cover 7 may have the bent portions 7*d* that contact the lower surface of the electric component mount 6 to support the electric component box 5. Thereby, the electric component mount 6 is also supported on its rear surface by the bent portions 7*d*, and thus is stably installed in the outdoor unit 100. Further, the electric component mount 6 is structured to come into contact with the bent portions 7*d* to be supported, and thus is easily installed.

The invention claimed is:

1. An outdoor unit of an air-conditioning apparatus, the outdoor unit comprising:

a housing;

a compressor disposed in the housing;

an outdoor heat exchanger connected to the compressor via a refrigerant pipe;

a fan configured to send air to the outdoor heat exchanger;

an electric component box including an electric component configured to control the compressor;

a dividing plate dividing an interior of the housing into a mechanical chamber accommodating the compressor and an air-sending chamber accommodating the fan, the dividing plate having an upper end with a catch hole;

an electric component mount disposed in the mechanical chamber above the compressor and partitioning the mechanical chamber to include an electric component chamber accommodating the electric component box;

a catch part provided on the electric component box on an upper surface of the electric component mount, the catch part being configured to engage the catch hole of the upper end of the dividing plate; and a heat exchanger cover separating the compressor and the outdoor heat exchanger from each other, wherein the heat exchanger cover has a bent portion provided on an upper end portion of the heat exchanger cover, the bent portion being in contact with a lower surface of the electric component mount and supporting the electric component box.

2. The outdoor unit of the air-conditioning apparatus of claim 1, wherein the electric component mount has an outer circumferential end provided with a cushioning material.

3. The outdoor unit of the air-conditioning apparatus of claim 2, further comprising a support part provided along an outer circumferential shape of the electric component mount, projecting from an inner wall of the housing toward the interior of the housing and supporting the electric component mount, wherein the cushioning material is continuously provided on the upper surface of the electric component mount, a side surface facing the inner wall of the housing, and a portion of the lower surface of the electric component mount in contact with the support part.

4. The outdoor unit of the air-conditioning apparatus of claim 1, wherein the electric component mount has an outer circumferential end provided with a cutout passing through the electric component chamber and the mechanical chamber to allow a wire to pass through the cutout.

5. The outdoor unit of the air-conditioning apparatus of claim 1, wherein the heat exchanger cover is bent toward the mechanical chamber, and wherein the heat exchanger cover is provided with a pipe port allowing the refrigerant pipe to pass through the pipe port, the pipe port being provided with a cushioning material.

* * * * *